United States Patent [19]

Kawasaki et al.

[11] 4,314,229

[45] Feb. 2, 1982

[54] FADER CONTROLLING VARIABLE RESISTOR

[75] Inventors: Atsushi Kawasaki; Yukio Munakata, both of Tokorozawa, Japan

[73] Assignee: Pioneer Electronic Corporation, Tokyo, Japan

[21] Appl. No.: 58,653

[22] Filed: Jul. 19, 1979

[30] Foreign Application Priority Data

| | | | |
|---|---|---|---|
| Jul. 21, 1978 | [JP] | Japan | 53-88263 |
| Jul. 21, 1978 | [JP] | Japan | 53-88264 |
| Jul. 21, 1978 | [JP] | Japan | 53-99647[U] |
| Jul. 21, 1978 | [JP] | Japan | 53-99648[U] |
| Jul. 21, 1978 | [JP] | Japan | 53-99649[U] |
| Aug. 16, 1978 | [JP] | Japan | 53-99121 |
| Aug. 16, 1978 | [JP] | Japan | 53-111479[U] |
| Aug. 16, 1978 | [JP] | Japan | 53-111480[U] |

[51] Int. Cl.[3] ..... H01C 10/30

[52] U.S. Cl. ..... 338/160; 338/167; 338/169

[58] Field of Search ..... 338/160, 161, 162, 163, 338/167, 169, 139, 172, 173, 191, 200; 337/102, 103, 407, 408; 219/264, 265

[56] References Cited

U.S. PATENT DOCUMENTS

| | | | |
|---|---|---|---|
| 3,827,014 | 7/1974 | Wehl | 337/407 |
| 3,996,550 | 12/1976 | Yano et al. | 338/161 X |
| 4,016,400 | 4/1977 | Seibel et al. | 219/265 X |
| 4,179,679 | 12/1979 | Houghland | 337/408 X |
| 4,186,366 | 1/1980 | McVey | 337/408 X |

*Primary Examiner*—C. L. Albritton

*Attorney, Agent, or Firm*—Sughrue, Mion, Zinn, Macpeak and Seas

[57] ABSTRACT

A fader controlling variable resistor adapted to adjust the balance in sound volume of the right and left loudspeakers, or the front and rear loudspeakers. When abnormal heat is generated in a variable resistor in a fader control circuit, the sliding piece of the variable resistor is disconnected from the resistance member by the utilization of a thermo-plastic resin of a low-melting-point material is readily deformed or molten by heat, to prevent a fire attributed to the generation of heat therein. In one embodiment of the invention, the sliding piece is maintained in contact with the resistance member against its elastic force by a protrusion of thermo-plastic resin. When abnormally high heat is generated in the variable resistor, the protrusion is molten, and the sliding piece is disconnected from the resistance member or the conductor.

3 Claims, 24 Drawing Figures

FADER CONTROLLING VARIABLE RESISTOR

BACKGROUND OF THE INVENTION

This invention relates to a circuit which is connected in a circuit extending from a power amplifier to loudspeakers thereof for balancing the sound volumes of the right and left loudspeakers or of the front and rear loudspeakers. That is, this invention relates to a variable resistor employed in a fader control circuit.

The fader control circuit is extensively employed in car radio receiver sets. For instance, in the case where a radio receiver set is provided near the operator's seat of a car, the fader control circuit is used so that the sound volumes of the right and left loudspeakers or of the front and rear loudspeakers can be balanced by a person on the rear seat. Alternatively, in the case where the loudspeakers are positioned at the right, left, front and rear sides of a person, the fader control circuit is used to adjust (balance) the sound volumes of the front and rear loudspeakers by adjusting the outputs of the right and left power amplifiers. In other words, the circuit is used to control the output of a power amplifier with a variable resistor.

Examples of the fader control circuit are shown in FIGS. 1 and 2. These circuits comprise a power amplifier A, the right and left, or front and rear, loudspeakers $SP_1$ and $SP_2$ and a variable resistor VR for adjusting output levels applied to the loudspeakers $SP_1$ and $SP_2$. As the sliding piece (wiper) of the variable resistor VR is moved, the power applied to the loudspeakers $SP_1$ and $SP_2$ is varied. That is, the sound volumes of the loudspeakers are changed relative to each other.

In general, the variable resistor VR is 40 to 80Ω in maximum resistance and 10 watts in capacity. The output power of the power amplifier A is higher, 20 to 40 watts maximum. Accordingly, when the input and output terminals of the variable resistor VR are shorted or opened, i.e. when for instance the voice coil of the loudspeaker $SP_1$ is shorted or the voice coil of the loudspeaker $SP_2$ is broken, and the sliding piece of the variable resistor is positioned as indicated by the dotted line in the figures. Then all of the output current of the power amplifier A will flow through a small part R of the resistance member of the variable resistor VR. As a result, heat is abnormally generated in the small part R while increasing the temperature thereof to for instance, several hundreds of degrees. This may cause a fire.

In order to eliminate this difficulty, or to prevent such a fire, heretofore a method has been employed in which a protection circuit is provided in a relevant device to detect the short-circuiting of one or both output terminals of the variable resistor. The device is then deenergized when the short-circuiting occurs.

However, the method is disadvantageous in that the protection circuit is expensive and the operation thereof is relatively unreliable.

SUMMARY OF THE INVENTION

In view of the foregoing, an object of this invention is to provide a fader controlling variable resistor in which, when heat extremely high in temperature is generated in the resistance member thereof, the sliding piece thereof is disconnected from the resistance member.

It is another object of this invention to provide for a variable resistor where a thermo-plastic resin or a low-melting-point material is readily molten or deformed by the heat thus generated, thereby to prevent the occurrence of a fire.

The foregoing and other objects of the invention will become more apparent from the following detailed description and the appended claims when read in conjunction with the accompanying drawings.

DETAILED DESCRIPTION OF THE INVENTION

Figure 1:
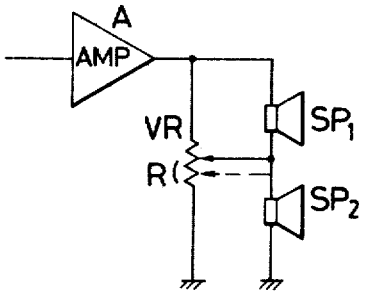
FIG. 1 PRIOR ART
FIGS. 1 and 2 are circuit diagrams showing conventional fader control circuits.
Figure 2:
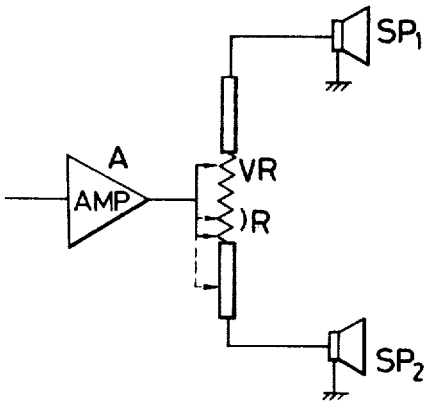
FIG. 2 PRIOR ART
Figure 3:
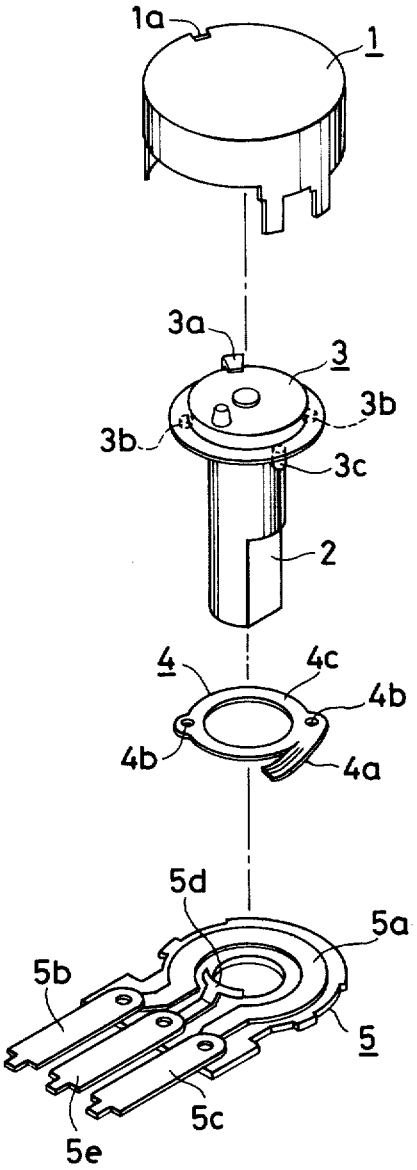
FIG. 3 is an exploded view perspective of a first embodiment of a fader controlling variable resistor according to this invention.
Figure 4:
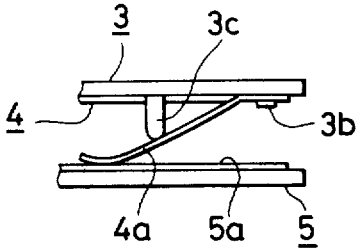
FIG. 4 is a side view showing the essential components of the variable resistor shown in FIG. 3.
Figure 5:
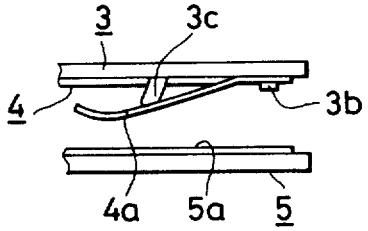
FIG. 5 is a side view showing a state of the essential components in the case when heat is generated in the variable resistor.

A first embodiment of a fader controlling variable resistor according to this invention is shown in FIGS. 3 through 5. It comprises a metal case 1 having a stopper 1*a* protruding inwardly, a shaft 2 and a mounting board 3 made of a thermoplastic resin and fixedly secured to the shaft 2. The mounting board 3 has an abutting protrusion 3*a* on the upper surface thereof. The abutting protrusion 3*a* is adapted to abut against the above-described stopper 1*a* to prevent the mounting board 3 from being turned through 360°. Formed on the lower surface of the mounting board 3 are protrusions 3*b* for mounting an electrically conductive ring 4 (described later) having a sliding piece 4*a*, and a protrusion 3*c* adapted to depress the middle portion of the sliding piece 4*a* against the elastic force of the same sliding piece 4*a*.

The ring 4 has a sliding ring section 4*c* with small holes 4*b* and 4*b* engaged with the protrusions 3*b* of the mounting board 3 and a sliding piece 4*a* extended from the sliding ring 4*c*. The ring 4 is fixedly mounted on the mounting board 3 by welding the protrusions 3*b* after the protrusions 3*b* are inserted into the holes 4*b*, respectively. When the ring 4 is mounted on the mounting board 3, the protrusion 3*c* abuts against substantially the middle portion of the sliding piece 4*a*. As a result, the sliding piece 4*a* is depressed downwardly and the end portion of the sliding piece 4*a* is brought into contact with a resistance member 5*a* (described later).

The resistance member 5*a* is formed as a substantially annular member and is mounted on a substrate 5 which is made of bakelite or the like. Both ends of the resistance member 5*a* are connected to terminal boards 5*b* and 5*c*, respectively, which are fixedly secured to the substrate 5 with eyelets or the like. A terminal board 5*e* and a sliding piece 5*d* which is slidably in contact with the sliding ring 4*c* are fixedly secured to the substrate with an eyelet or the like.

The mounting board 3 is inserted in the case 1, and the substrate 5 is mounted in the case 1. As a result, the sliding pieces 4*a* and 5*d* are set to be slidably in contact with the resistance member 5*a* and the sliding ring 4*c*, respectively.

When large current flows between the sliding piece 4*a* and the resistance member 5*a* with the result that heat is generated in the resistance member 5*a*, then the sliding piece 4*a* is heated, and the heat of the sliding piece 4*a* is transmitted to the protrusion 3*c*. As the heating temperature is increased, the protrusion 3*c* is softened. Therefore, the protrusion 3*c* is deformed by the elastic force of the sliding piece 4*a*. As a result, the sliding piece 4*a* is disconnected from the resistance member 5*a*, and the current flowing through the sliding piece 4*a* is interrupted. Thus, the heat generation is suspended.

In the above-described embodiment, the protrusion 3*c* is depressed downwardly against the elastic force of the sliding piece 4*a*, so that the latter 4*a* is brought under pressure in contact with the resistance member 5*a*. However, the generation of heat can be prevented by employing a method in which a protrusion of thermo-plastic resin is provided on the substrate 5 in such a manner that the protrusion brings the sliding piece 5*d* in contact with the sliding ring 4*c*. In this case, the sliding piece 5*d* is disconnected from the sliding ring 4*c* when the protrusion is molten by heat, to prevent the generation of heat.

Figure 6:
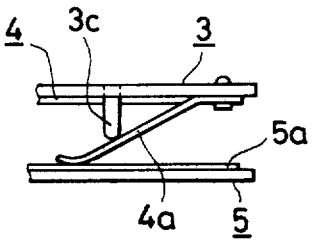
FIG. 6 is a side view showing the essential components of the variable resistor according to a modification of the first embodiment of this invention.
Figure 7:
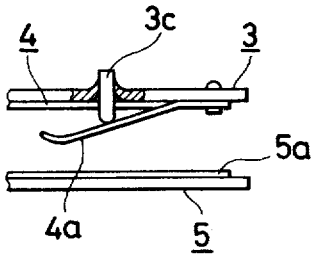
FIG. 7 is a side view showing a state of the essential components in the case when heat is generated in the variable resistor.

An example of a modification of the variable resistor of the first embodiment will be described with reference to FIGS. 6–7. In this embodiment the substrate 5 is the same construction as in FIG. 3. The pin 3*c* is however not made of thermo-plastic resin but is formed from a material that does not deform upon the application of heat. Instead, the mounting board 3 is made of a thermoplastic resin that is deformable upon the application of heat. The pin 3*c* as shown in FIG. 6 provides bias action to the slider 4*a* to bring it into contact with the resistance member 5*a*. However, upon the generation of heat, the mounting board 3 tends to soften and be readily deformable. Therefore, the pin 3*c* is pushed upwardly by the elastic force of the sliding piece 4*a*, so that the sliding piece is disconnected from the resistance member 5*a* and the flow of current to the resistance member 5*a* is interrupted to suspend the generation of heat therein.

In the example described above, the pin 3*c* depresses downwardly against elastic force of the sliding piece 4*a* so that the sliding piece is in contact with the resistance member 5*a*. However, the same effect can be obtained by a modification where the sliding piece 5*d* is pushed upwardly with a pin provided on the substrate 5 made of thermo-plastic resin to be in contact with the sliding ring 4*b*.

The material of the mounting board 3 or the substrate 5 is not limited to the thermo-plastic resin; that is, it may be any material if it is readily deformed by heat.

Accordingly, then, in this embodiment, the sliding piece is brought into contact with the resistance member or the conductor against its elastic force by means of the pin which is provided on the deformable mounting board or the substrate. Accordingly, when the abnormally high heat is generated in the resistance body, the pin is heated thereby and as a result the pin is retracted to permit the sliding piece to disconnect from the resistance member or the conductor with the aid of its elastic force. Therefore, the current flowing through the resistance member or the conductor is interrupted to suspend the generation of heat therein thereby to prevent the occurrence of a fire.

Figure 8:
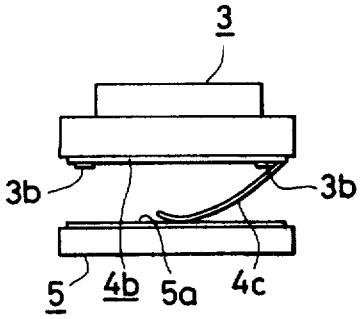
FIG. 8 is a side view showing the essential components of the variable resistor according to a second modification of this invention.
Figure 9:
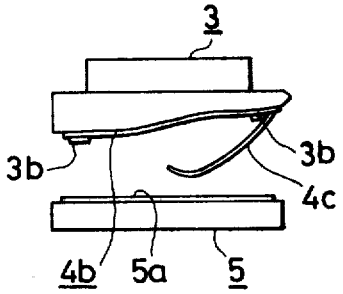
FIG. 9 is a side view showing a state of the essential components in the case when heat is generated in the variable resistor.

A second modification of the first embodiment of the variable resistor according to the invention is shown in FIGS. 8–9. The case, mounting board and substrate are the same as in FIG. 3. However, the mounting board 3 is made of a thermo-plastic resin fixedly secured to the shaft 2.

When large current flows between the sliding piece 4*c* and 5*a*, heat is generated in resistance member. As a result, sliding piece 4*c* and the sliding ring 4*b* are heated, and the mounting board 3 gradually contracts. As the heating temperature is increased, the contraction of the mounting board 3 is also increased. As a result, the sliding ring 4*b* is deformed and therefore the sliding piece 4*c* is disconnected from the resistance member 5*a* as shown in FIG. 9. Accordingly, the current flowing through the sliding piece 4*c* is interrupted, and the generation of heat is suspended.

In the modification described above, the mounting board 3 is made of the thermocontractive resin; however, the same effect can be obtained by using a mounting board which is made of a material which is molten by heat or a material which is readily deformed by heat.

Figure 10:
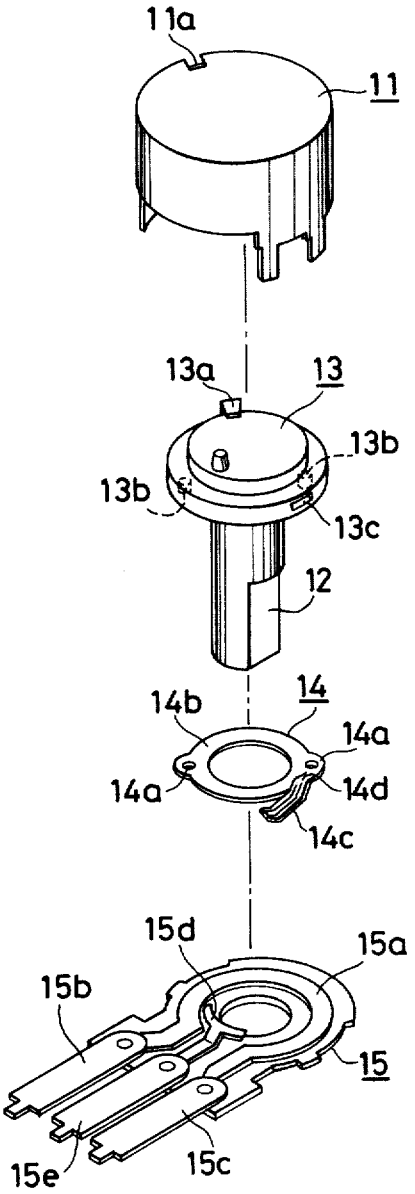
FIG. 10 is an exploded perspective view of a second embodiment of the variable resistor according to the invention.
Figure 11:
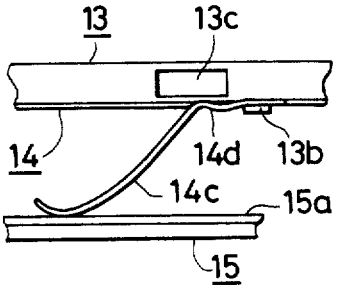
FIG. 11 is a side view showing the essential components of the variable resistor shown in FIG. 8.
Figure 12:
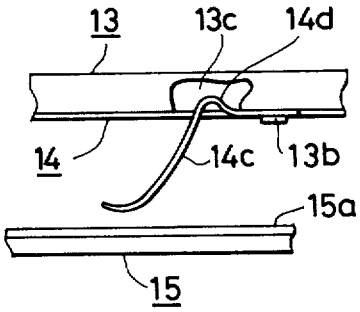
FIG. 12 is a side view showing a state of the essential components in the case when heat is generated in the variable resistor.

A second embodiment of the variable resistor according to the invention is shown in FIGS. 10 through 12. This embodiment comprises a metal case 11 having a stopper 11*a* protruding inwardly, a shaft 12, and a mounting board 13 made of a thermoplastic resin and fixedly secured to the shaft 12. The mounting board 13 has an abutting protrusion 13*a* on the upper surface thereof. The abutting protrusion 13*a* is adapted to abut against the above-described stopper 11*a* to prevent the mounting board 13 from being turned through 360°.

The variable resistor further comprises an electrically conductive ring 13 having a sliding ring 14*b* with small holes 14*a* and 14*a* which are engaged with and welded to protrusions 13*b* and 13*b* formed in the lower surface of the mounting board 13, and a sliding piece 14*c* extending from the sliding ring 14*b*. The sliding piece 14*c* has a step part 14*d* protruding upwardly. When the ring 14 is mounted on the mounting board 13, the step part 14*d* abuts against the mounting board 13, and therefore the end portion of the sliding piece 14*c* is moved downwardly. A cavity 13*c* is formed in the part of the mounting board 13 against which the step part 14*d* abuts. That is, the part of the mounting board 13 is thinner than the remaining parts.

The variable resistor further comprises a substrate 15 made of bakelite or the like. A substantially annular resistance member 15*a* is formed on the substrate 15. The end portion of the above-described sliding piece 14*c* is brought into contact with the resistance member 15*a*. Both ends of the resistance member 15*a* are connected to terminal boards 15*b* and 15*c*, respectively, which are fixedly secured to the substrate 15 with eyelets or the like. The substrate 15 is provided with a terminal board 15*e* and a sliding piece 15*d* which is slidably in contact with the sliding ring 14*b*. The terminal board 15*e* and the sliding piece 15*d* are fixedly secured to the substrate 15 with an eyelet or the like. Hence, the substrate construction is similar to the first embodiment.

When the mounting board 13 is inserted in the case 11 and the substrate 15 is mounted in the case, the sliding pieces 14*c* and 15*d* are set to be slidably in contact with the resistance member 15*a* and the sliding ring 14*b*, respectively.

When large current flows between the sliding piece 14*c* and the resistance member 15*a*, heat is generated in the latter 15*a*, and the sliding piece 14*c* is heated thereby. As a result, the part of the mounting board 13 where the cavity 13*c* is formed is also heated, and it melts or deforms as the temperature of the heat is increased. When the part directly above the step part 14*d* melts or is softened, that part of the sliding piece 14*c* is inserted into the cavity 13*c*. This is shown in FIG. 12. The result is that sliding piece 14*c* is disconnected from the resistance member 15*a*. Accordingly, the current flowing through the sliding piece 14*c* is interrupted, and the generation of heat is suspended.

In the above-described second embodiment, the step part 14*d* is formed in the sliding piece 14*b*. However, the same effect can be obtained by employing a method in which a protrusion is formed by cutting a part of the sliding piece so that it is elastically abutted against the mounting board 13. The elastic force thereof is then utilized to cause the sliding piece 14*c* itself to abut against the resistance member. Alternatively, a technique can be used in which the substrate 15 is made of thermo-plastic resin and the sliding piece 15*d* is formed similarly as in the above-described example.

The provision of the cavity 13*c* is not always necessary. The same effect can be obtained without the cavity 13*c*, if the mounting board 13 is made of a material which is deformed or contracted by heat.

Figure 13:
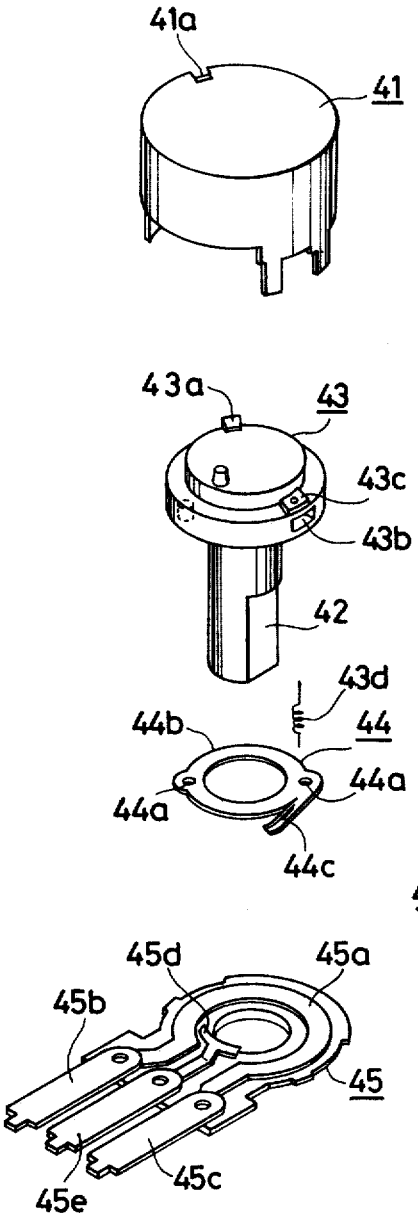
FIG. 13 is an exploded perspective view of a third embodiment of the variable resistor according to the invention.
Figure 14:
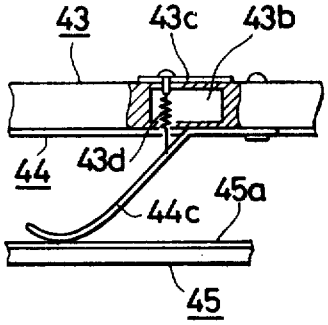
FIG. 14 is a side view showing the essential components of the variable resistor shown in FIG. 13.
Figure 15:
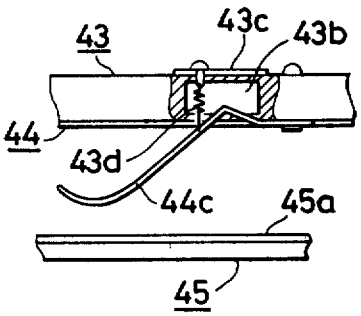
FIG. 15 is a side view showing a state of the essential components in the case when heat is generated in the variable resistor.

A third embodiment of the variable resistor according to the invention, as shown in FIGS. 13, 14 and 15, comprises a metal case 41 having a stopper 41*a* extended inwardly, a shaft 42, and a mounting board 43 which is made of a material such as thermo-plastic resin or thermocontractive resin which is readily deformed by the application of heat. In this sense this embodiment is similar to the FIGS. 10–12 embodiment. The mounting board 43 has an abutting protrusion 43*a* on its upper surface, which abuts against the stopper 42*a* to prevent the mounting board 43 from being turned through 360°.

The variable resistor further comprises an electrically conductive ring 44 having a sliding ring 44*b* with small holes 44*a* which engage with welded protrusions formed on the lower surface of the mounting board 43, and a sliding piece 44*c* extending from the sliding ring 44*b*.

A cavity 43*b* is formed in the part of the mounting board 43, which corresponds to the base portion of the sliding member 44, so that this part of the mounting board is thinner than the other parts. An external spring 43*b* is inserted in the cavity 43*b* with the upper end secured to a fixing board 43*c* on the mounting board 43 and with the lower end secured to the middle portion of the sliding piece 44*c*. This is shown in FIG. 14. The sliding piece 44*c* has a section in contact with the thin wall on the mounting board before lowering into contact with the resistance member.

The variable resistor further comprises a substrate 45 made of bakelite or the like, on which a substantially annular resistance member 45*a* is formed. The two ends of the resistance member 45*a* are connected to terminal boards 45*b* and 45*c*, respectively, which are fixedly secured to the substrate 45 with eyelets or the like. The substrate 45 is provided with a terminal board 45*e* and a sliding piece 45*d* which is set to be slidably in contact with the sliding ring 44*b*. This is identical to the substrate components of the other embodiments.

Similarly as in the above-described embodiments, the mounting board 43 is inserted in the case 41 and the substrate 45 is mounted in the case 41, so that the sliding pieces 44*c* and 45*d* are set to be slidably in contact with the resistance member 45*a* and the sliding ring 44*b*, respectively.

When the sliding piece 44*c* is positioned near the end of the resistance member 45*a*, the resistance of the latter 45*a* is decreased (to about 2Ω). As a result, abnormally high heat may be generated in the resistance member 45*a* by large current flowing therein. Therefore, the sliding piece 44*c* is heated by the heat generated in the resistance member 45*a*. The thin part of the mounting board, where the cavity 43*b* has been formed, becomes molten as the heating temperature is increased. As a result, the sliding piece 44*c* is pulled by the elastic force of the external spring 43*d*, so that a part of the sliding piece 44*c* previously in contact with the sliding member 44 is moved into the cavity 43*b*, whereupon the end of the sliding piece 44*c* is disconnected from the resistance member 45*a*. Accordingly, the current flowing through the sliding piece 44 is interrupted, and therefore the generation of heat is suspended.

In the third embodiment described above, the sliding piece 44*c* is mounted on the mounting board 43 and is pulled by the external spring 43*d*. However, the same effect can be obtained by employing a method in which the substrate 45 is made of a material such as thermoplastic resin and the sliding piece 45*d* is secured similarly as in the above-described example. Furthermore, the provision of the cavity 43*b* is not always necessary. That is, if the mounting board is made of a material which is readily molten or deformed by heat, the same effect can be obtained.

Figure 16:
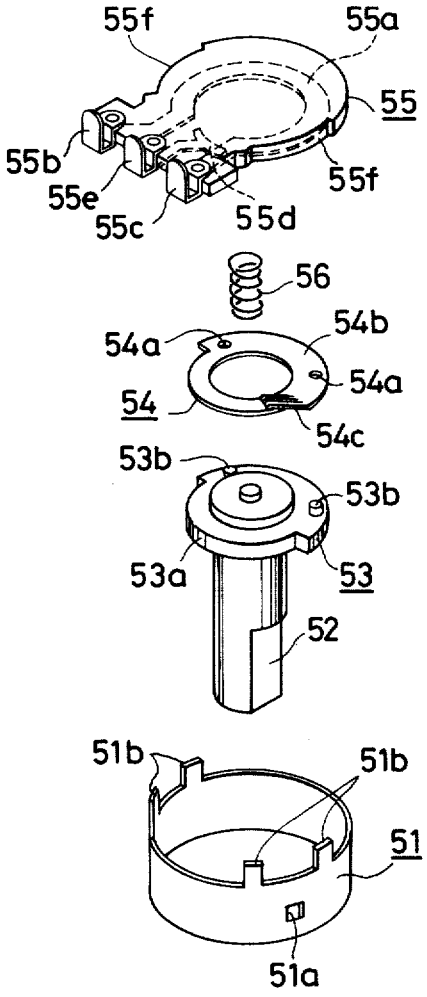
FIG. 16 is an exploded perspective view of a fourth embodiment of the variable resistor according to the invention.
Figure 17:
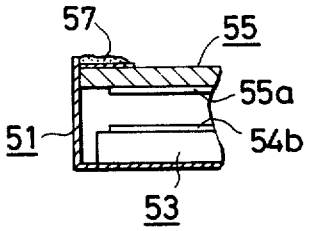
FIG. 17 is a side view showing the essential components of the variable resistor shown in FIG. 16.
Figure 18:
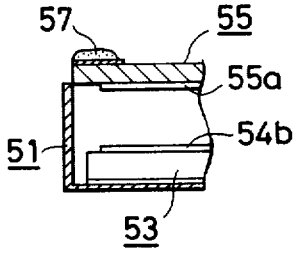
FIG. 18 is a side view showing a state of the essential components in the case when heat is generated in the variable resistor.

A fourth embodiment of the variable resistor according to the invention is shown in FIGS. 16 through 18.

The variable resistor comprises a metal case 51 having a stopper 51*a* protruded inwardly, a shaft 52 which is turned to change the resistance thereof, and a mounting board 53 fixedly secured to the shaft 52. The mounting board 53 has a cut 53*a* which is engaged with the stopper 51*a* to prevent the mounting board 53 from being turned through 360° degrees. The variable resistor further comprises an electrically conductive ring 54, and a substrate 55 made of a bakelite or the like. The ring 54 has a sliding section 54*b* with small holes 54*a* which are engaged with and welded to protrusions 53*b* formed on the upper surface of the mounting board 53, and a sliding piece 54*c* extending from the sliding section 54*b*. A substantially annular resistance member 55*a* is formed on the substrate 55. The two ends of the resistance member 55*a* are connected to terminals boards 55*b* and 55*c*, respectively, which are fixedly secured to the substrate 55 with eyelets or the like. The substrate 55 is provided with a terminal board 55*e* and a sliding piece 55*d* which is set to be slidably in contact with the sliding ring 54*b*. The terminal board 55*e* and the sliding piece 55*d* are fixedly secured to the substrate 55 with an eyelet or the like.

In FIG. 16, reference numeral 56 designates a spring disposed between the mounting board 53 and the substrate 55 to maintain the substrate 55 biased upward at all times.

The subassembly of the ring 54, mounting board 53 and shaft 54 is inserted into the case 51, and the substrate 55 with the spring 56 is mounted in the case 51 in such a manner that protrusions (or lugs) 51*b* formed on the case 51 coincide with recesses 55*f* formed in the substrate 55. Thereafter, the protrusions 51*b* are soldered with low-melting-point solder 57 (FIG. 17) so that the substrate 55 may not be removed from the case 51 by the elastic force of the spring 56.

When heat is generated in the resistance member 55*a* by a large current flowing through the sliding piece 54*c* and the resistance member 55*a*, the variable resistor is heated in its entirety and the temperature of the case 51 is increased. As a result, the solder 57 is molten by the heat, and therefore the substrate 55 is pushed upward and removed from the case 51 by the elastic force of the spring 56. Accordingly, the sliding piece 54*c* is disconnected from the resistance member 55*a*, the current is interrupted, and the generation of heat is suspended.

In the fourth embodiment described above, the substrate 55 is depressed by the spring 56. However, if the sliding piece 54*c* has a sufficiently high elastic force, then the spring 56 may be eliminated. Furthermore, if a plate which can be soldered is provided on the substrate 55, then the case 51 may be soldered to the plate. Instead of using the solder, a low-melting-point material such as thermo-plastic resin or resin which can be readily molten or weakened by heat can be employed to fix the case to the substrate.

Figure 19:
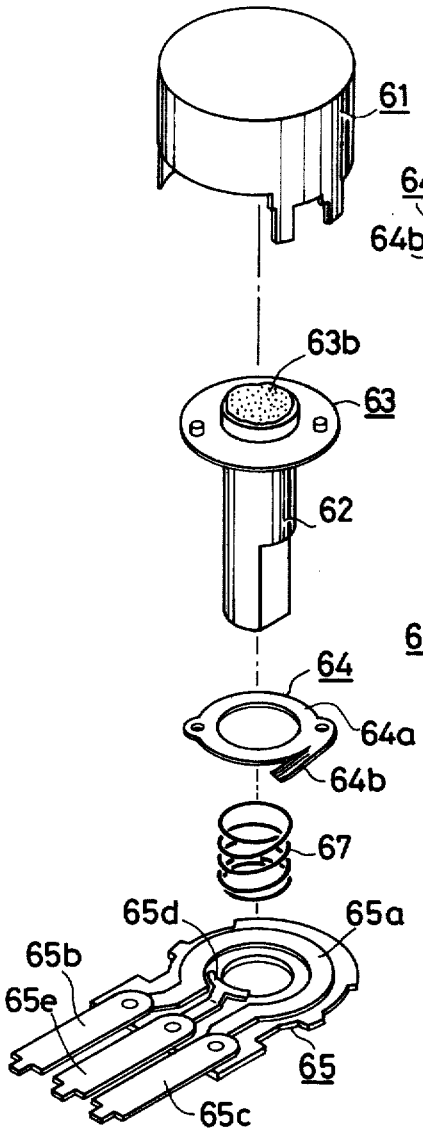
FIG. 19 is an exploded perspective view of a fifth embodiment of the variable resistor according to the invention.
Figure 20:
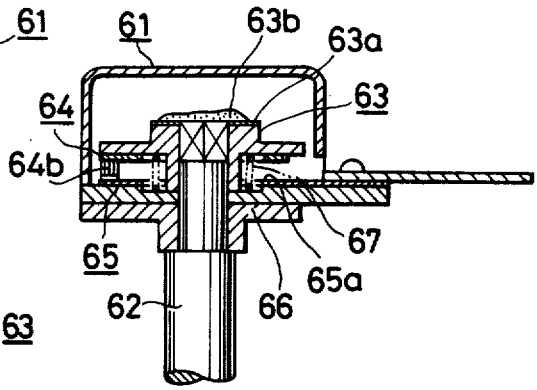
FIG. 20 is a side view showing the essential components of the variable resistor shown in FIG. 19.
Figure 21:
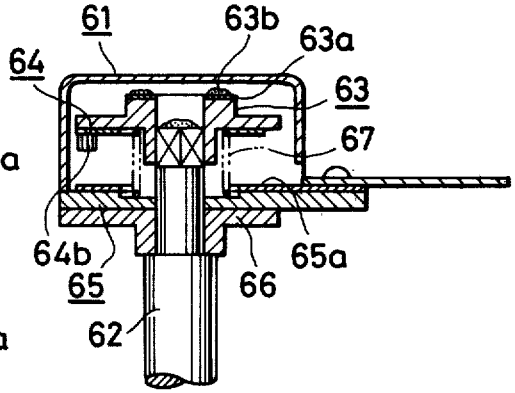
FIG. 21 is a side view showing a state of the essential components in the case when heat is generated in the variable resistor.

A fifth embodiment of the variable resistor according to the invention is shown in FIGS. 19, 20 and 21. It comprises a metal case 61, a shaft 62, and a mounting board 63 which is removably placed over the shaft 62. A metal plate or a metal film 63*a* which can be soldered is provided on the mounting board 63. The metal plate or metal film 63*a* is coated with low-melting-point solder 63*b* in such a manner that the solder covers the top surface of the shaft 62 to fixedly secure the mounting board 63 to the shaft 62.

The variable resistor further comprises an electrically conductive ring 64, and a substrate 65 made of bakelite or the like. The ring 64 has a sliding ring 64*a* secured to the lower surface of the mounting board 63, and a sliding piece 64*b* extended from the sliding ring 64*a*. The end of the sliding piece 64*b* is slidably in contact with a substantially annular resistance member 65*a* formed on the substrate 65. The two ends of the resistance member 65*a* are connected to terminal boards 65*b* and 65*c*, respectively, which are fixedly secured to the substrate 65 with eyelets or the like. A terminal board 65*e* and a sliding piece 65*d* slidably in contact with the sliding ring 64*b* are fixedly secured to the substrate 65 with an eyelet or the like. A shaft journal 66 is fixedly mounted on the lower surface of the substrate 65 (FIG. 20). A spring 67 is provided between the mounting board 63 and the substrate 65.

The mounting board 63 is inserted in the case 61 and the substrate 65 is mounted in the case 61, so that the sliding pieces 64*b* and 65*d* are set to be slidably in contact with the resistance member 65*a* and the sliding ring 64*a*, respectively. When heat is generated by a large current flowing through the sliding piece 64*b* and the resistance member 65*a*, the variable resistor is heated in its entirety.

As the temperature of the case 61 is increased, the solder 63*b* is molten. As a result, the mounting board 63 is removed from the head of the shaft 62 by the elastic forces of the sliding piece 64*b* and the spring 67, whereupon the sliding piece 64*b* is disconnected from the resistance member 65*a* as shown in FIG. 21. Accordingly, the current flowing through the sliding piece 64*b* is interrupted, and the generation of heat is suspended.

In the fifth embodiment described above, the mounting board 63 is coated with the solder 63*b*. However, if the shaft 62 is made of a material which can be soldered, then the same effect can be obtained by solding the shaft 62. The provision of the spring 67 is not always necessary. That is, the mounting board 63 may be removed from the top of the shaft only by the elastic force of the sliding piece 64. Furthermore, instead of the solder, a low-melting-point material such as thermo-plastic resin or resin which can be readily molten by heat can be employed.

Figure 22:
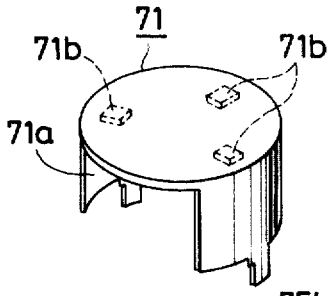
FIG. 22 is an exploded perspective view of an sixth embodiment of the variable resistor according to the invention.
Figure 23:
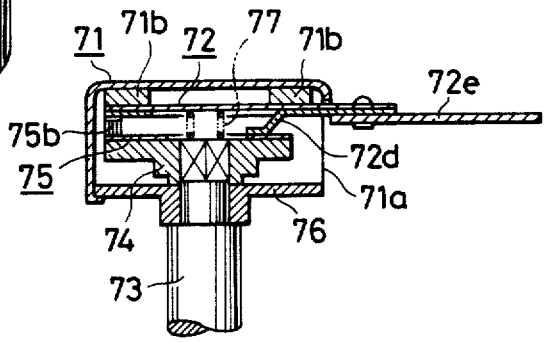
FIG. 23 is a side view showing the essential components of the variable resistor shown in FIG. 22.
Figure 23:
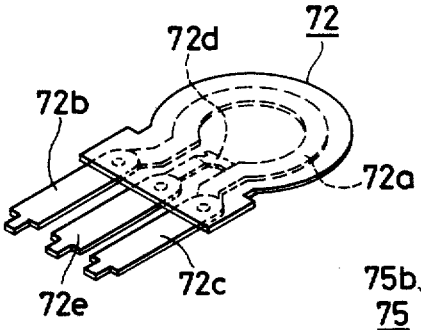
Figure 24:
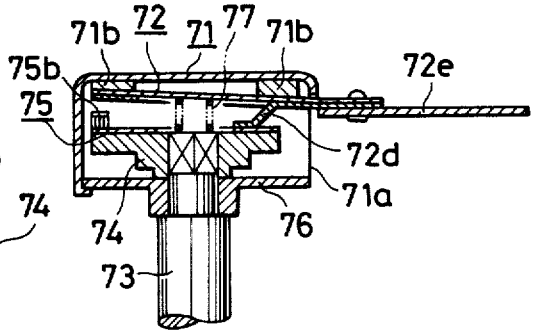
FIG. 24 is a side view showing a state of the essential components in the case when heat is generated in the variable resistor.
Figure 24:
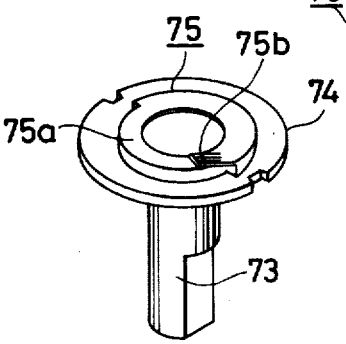

A sixth embodiment of the variable resistor according to the invention, is shown in FIGS. 22, 23 and 24, comprises: a case 71, a substrate 72 made of bakelite or the like, a shaft 73, a mounting board 74, and an electrically conductive ring 75.

The case 71 has a cut portion 71*a* through which a part of the substrate 72 is extended outwardly, and three spacers 71*b* bonded to the inner surface of the bottom thereof. The spacers 71*b* are made of a material such as resin which is readily deformed, contracted or molten by heat. A substantially annular resistance element 72*a* is formed on the substrate 72. The two ends of the resistance element 72*a* are connected to terminal boards 72*b* and 72*c*, respectively, which are fixedly secured to the substrate 72 with eyelets or the like. A terminal board 72*e* and a sliding piece 72*d* slidably in contact with a sliding ring 75*a* are fixedly secured to the substrate 72 with an eyelet or the like. The mounting board 74 is fixedly secured to the shaft 73. The ring 74 is also fixedly mounted on the upper surface of the mounting board 74 and has a sliding piece 75*b* extending from the peripheral portion of the sliding ring 75*a*. The sliding piece 75*b* is set to be slidably in contact with the resistance member 72*a*.

A shaft journal 76 is fixedly secured to the case 71 and the shaft 73 is inserted into the shaft journal 76. A spring 77 is interposed between the shaft 73 and the substrate 72 to depress the substrate toward the case 71 at all times.

The substrate 72 is mounted through the spacers 71*b* in the case 71 and the shaft 73 inserted into the shaft journal 76 is mounted in the case 71, so that the sliding pieces 75*b* and 72*d* are set to be slidably in contact with the resistance member 72*a* and the sliding ring 75*a*, respectively.

When the resistance of the variable resistor is decreased (to about 2Ω) by positioning the sliding piece 75*b* near the end of the resistance member 72*a*, a large current flows in the resistance member 72*a* and abnormally high heat is generated therein. The substrate 72 is heated by the heat thus generated, and accordingly, the spacers 71*b* are deformed, contracted or molten, whereupon the substrate 72 is shifted toward the case 71 by the elastic force of the spring 77. In other words, as soon as the spacers 71*b* are deformed, contracted or molten by the heat, the substrate 72 is displaced as shown in FIG. 24, whereupon the sliding piece 75*b* is disconnected from the resistance member 72*a*. Accordingly, the current is interrupted, and the generation of heat is suspended.

While the invention has been described with respect to the embodiments herein, it is apparent that other modifications are possible without departing from the essential scope thereof.

What is claimed is:

1. A variable resistor comprising: a casing, a mounting board, a conductive element mounted on said mounting board and having a sliding member, a substrate having terminals and a resistance member mounted thereon, said sliding member disposed so as to contact said resistance member, and heat responsive deformable means adapted to discontinue the contact between said sliding member and said resistance member when the temperature of said resistance member exceeds a predetermined level, wherein said heat responsive deformable means includes a section of said mounting board adapted to be responsive to the generation of heat and deform in order to discontinue contact between the sliding member and the resistance member, said mounting board including a thin wall section made of a heat responsive material, and a cavity adjacent said thin wall section.

2. The variable resistor of claim 1 wherein a section of said mounting board is made of heat responsive material deformable by heat to alter the position of said sliding member.

3. The variable resistor of claim 1 further comprising a spring member extending through said cavity and coupling said sliding member to said mounting board.

* * * * *